US005373427A

United States Patent [19]

McLean

[11] Patent Number: 5,373,427

[45] Date of Patent: Dec. 13, 1994

[54] DISPENSER WITH SOURCE OF ILLUMINATION FOR SELF-DEFENSE SPRAY CANISTER

[76] Inventor: Roderick G. McLean, 1659 N. Lake Rd., Cazenovia, N.Y. 13035

[21] Appl. No.: 119,918

[22] Filed: Sep. 10, 1993

[51] Int. Cl.[5] ..... F21V 33/00

[52] U.S. Cl. ..... 362/96; 362/101; 362/109; 362/205; 222/192

[58] Field of Search ..... 362/96, 101, 109, 110, 362/111, 112, 202, 205, 253, 102; 222/78, 79, 192; 273/84 ES

[56] References Cited

U.S. PATENT DOCUMENTS 2,625,764 1/1953 O'Brien et al. .
3,716,170 2/1973 Mangels .
3,776,429 12/1973 Delucia ..... 362/96
4,153,927 5/1979 Owens .
4,195,329 3/1980 Woog ..... 362/253
4,301,946 11/1981 Goldin et al. ..... 362/96
4,414,610 11/1983 Gale et al. .
4,449,474 5/1984 Mariol ..... 362/96
5,041,951 8/1991 Fan .

*Primary Examiner*—Richard R. Cole
*Assistant Examiner*—Y. Quach
*Attorney, Agent, or Firm*—Harris Beach & Wilcox

[57] ABSTRACT

A hand-held protective dispenser with a source of illumination includes a head portion formed on one end of a handle segment generally perpendicular thereto. The other end of the handle is openable and formed to receive a canister of self-defense spray and a battery pack to supply power to the source of illumination. The source of illumination is positioned on one side of the head portion while an articulating switch is provided on the other. The switch activates the source of illumination while either preventing or allowing access to a spray canister contained within the dispenser.

14 Claims, 4 Drawing Sheets

DISPENSER WITH SOURCE OF ILLUMINATION FOR SELF-DEFENSE SPRAY CANISTER

BACKGROUND OF THE INVENTION

1. Field of the Invention

This invention relates in general to a protective device for warding off potential assailants or attackers, the device being easily carried on one's person and rapidly and effectively used under poor lighting conditions or during periods of darkness. In particular, the present invention relates to a non-lethal personal self-defense device. More specifically, but without restriction to the particular embodiment hereinafter shown and described, this invention relates to a dispenser adapted to receive a canister of self-defense spray, the dispenser having a source of illumination for identifying an assailant and aiming a shot or stream of self-defense spray along an illuminated path.

2. Discussion of the Background Art

The art of portable protective devices has been contributed to by a number of proposed devices including, for example, the devices disclosed in U.S. Pat. Nos. 4,414,610 and 4,153,927 issued, respectively, to E. A. Gale et al. and O. E. Owens.

The Gale et al. patent is directed to a laser-sighted briefcase firing device including a laser-type sighting device mounted on a rigid base within the briefcase. A firing piece enclosed within the briefcase is mounted proximate to the sighting device. The case is provided with a pair of small apertures, one for the barrel of the firing piece and the other for allowing a laser beam to be projected out from the case and onto a target. The device can thus be aimed and then triggered by a mechanism positioned near the handle of the case.

Personal assaults are becoming more commonplace. Many of these attacks are directed at women and occur at night or in areas having poor lighting. As a result, many people, particularly women, are carrying aerosol canisters filled with a self-defense spray such as mace. These canisters are being carried on the individual's person or in their pocketbooks or briefcases for the purpose of defending the individual against assaults. As is well known, spraying a stream of self-defense spray such as mace into the facial region of a potential attacker will temporarily disable the attacker and provide the intended victim an opportunity to escape. However, locating the canister and effectively aiming and firing its contents under emergency conditions is oftentimes difficult for the average, untrained person.

In addition, law enforcement officers are under increasing pressure to subdue unruly suspects without resorting to violence or unnecessary force. While existing self-defense spray dispensers offer the means to accomplish this end, they are under utilized because they are difficult to aim accurately at night, or in poor lighting conditions, and can endanger the officer, should the indiscriminately dispensed chemical drift back and come in contact with the officer.

The device described in the Owens patent gives law enforcement personnel a choice between a lethal and nonlethal weapon by providing a multi-purpose clipboard which contains a gun, a flashlight, a camera, a tape recorder and a gas or mace canister. The clipboard can also be used as a protective shield. The canister is mounted beneath the flashlight and is adapted to fire laterally through one side wall of the clipboard structure. The canister trigger is mounted on top of the board and in a fully exposed location. Accordingly, directing the canister discharge onto a specific target is extremely difficult and requires the use of both hands. In addition, because of its exposed trigger, the canister can be accidentally fired and cannot be conveniently carried in a pocketbook or carrying case.

OBJECTS AND SUMMARY OF THE INVENTION

It is, therefore, an object of the present invention to improve non-lethal personal defense devices.

It is a further object of the present invention to enable a portable hand-held dispenser to receive a canister of self-defense spray.

Still another object of the present invention is to utilize a source of illumination in a portable hand-held dispenser formed to receive a canister of self-defense spray.

It is yet a further object of the present invention to prevent the loading of a self-defense spray canister into a portable hand-held dispenser formed to receive the canister unless the canister is in a safety locked condition.

An additional object of the present invention is to allow a source of illumination utilized in a portable hand-held dispenser formed to receive a canister of self-defense spray to be activated while preventing access to the canister.

Yet another object of the present invention is to activate a source of illumination utilized in a portable hand-held dispenser formed to receive a canister of self-defense spray while allowing access to the canister.

These and other objects are attained in accordance with the present invention wherein there is provided a hand-held protective device adapted to receive a canister of self-defense spray. The device includes an elongated handle segment that is easily gripped by one hand, and capable of supporting a battery pack. In accordance with one aspect of the present invention, one end of the handle segment is provided with a head portion including a source of illumination and a spray aperture formed proximate the source of illumination. A circuit for electrically connecting the battery pack to the source of illumination is provided within the device.

According to another aspect of the invention, the present device includes an articulating switch disposed proximate the head portion and cooperatively engaged with the circuit. The articulating switch is utilized for either opening and closing the circuit while simultaneously preventing access to a canister of self-defense spray contained within the device or closing the circuit while allowing access to the canister.

A further aspect of the device in accordance with the present invention, includes providing the device with guiding ribs within an internal cavity of the handle segment and centering ribs around the spray aperture in the head portion. The combined action of the ribs allow a typical self-defense spray canister to be properly loaded into the device only in a locked condition while a nozzle aperture in the cap of the canister is aligned with the spray aperture in the head portion.

BRIEF DESCRIPTION OF THE DRAWING

Further objects of the present invention together with additional features contributing thereto and advantages accruing therefrom will be apparent from the following description of a preferred embodiment of the invention which is shown in the accompanying drawing with like reference numerals indicating like components throughout, wherein.

DETAILED DESCRIPTION OF A PREFERRED EMBODIMENT

Figure 1:
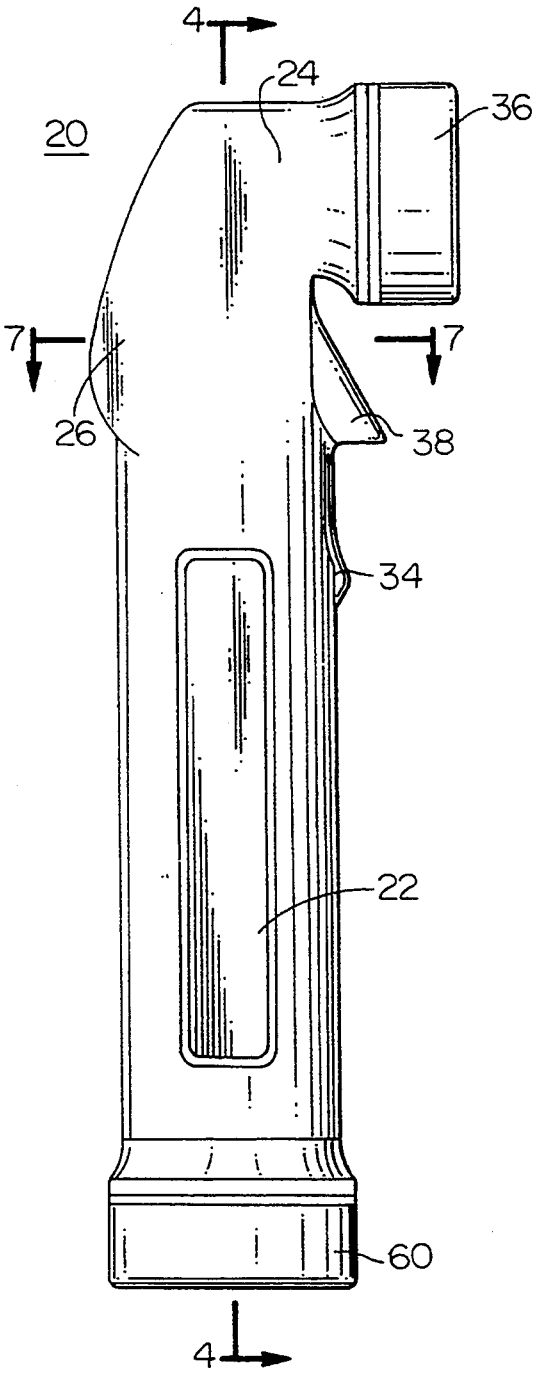
FIG. 1 is a side elevational view of a portable hand-held dispenser in accordance with the present invention.
Figure 2:
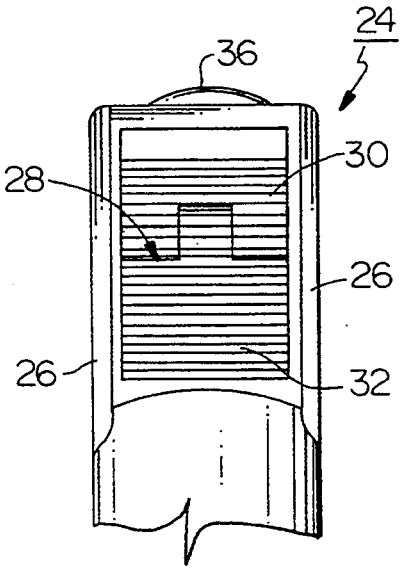
FIG. 2 is a rear elevational view of the head portion of the device of FIG. 1, showing the articulating switch thereof biased against the head.
Figure 3:
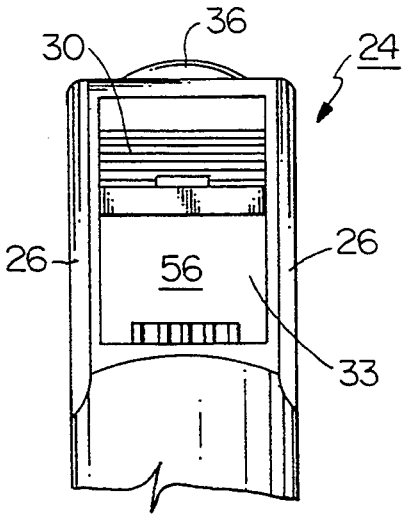
FIG. 3 is a view similar to FIG. 2 showing the articulating switch in an elevated condition.

Referring now to the drawing and initially to FIGS. 1-3, there is shown a hand-held protective dispenser 20 in accordance with the present invention. The dispenser 20 includes an elongated handle segment 22 having an axis of elongation and a head portion 24 which is substantially perpendicular to the handle segment 22. The head portion 24 includes a pair of raised narrow ridges 26, generally parallel to each other. The narrow ridges 26 begin at the top of the head and slope downwardly therefrom as shown in FIG. 1. An articulating switch or flat knob 28 is positioned between the raised narrow ridges 26. The switch 28 has an upper portion 30 and a lower portion 32. The head portion 24 also includes a passage or through-way 33 as shown in FIG. 3. The upper and lower portions 30 and 32, respectively, of the switch 28 will be described in further detail hereinafter. As shown in FIG. 1, the handheld protector dispenser 20 includes a finger grip 34 which is positioned below a source of illumination 36 and a spray aperture 38. During use of the hand-held protective dispenser 20, the handle segment may be grasped in either the right or left hand, with the forefinger of the user's hand positioned below the spray aperture 38 resting against the finger grip 34. A secure grip of the dispenser 20 is completed by wrapping the palm around the side portion of the device and extending the thumb around one of the ribs 26 and onto the switch 28.

Figure 4:
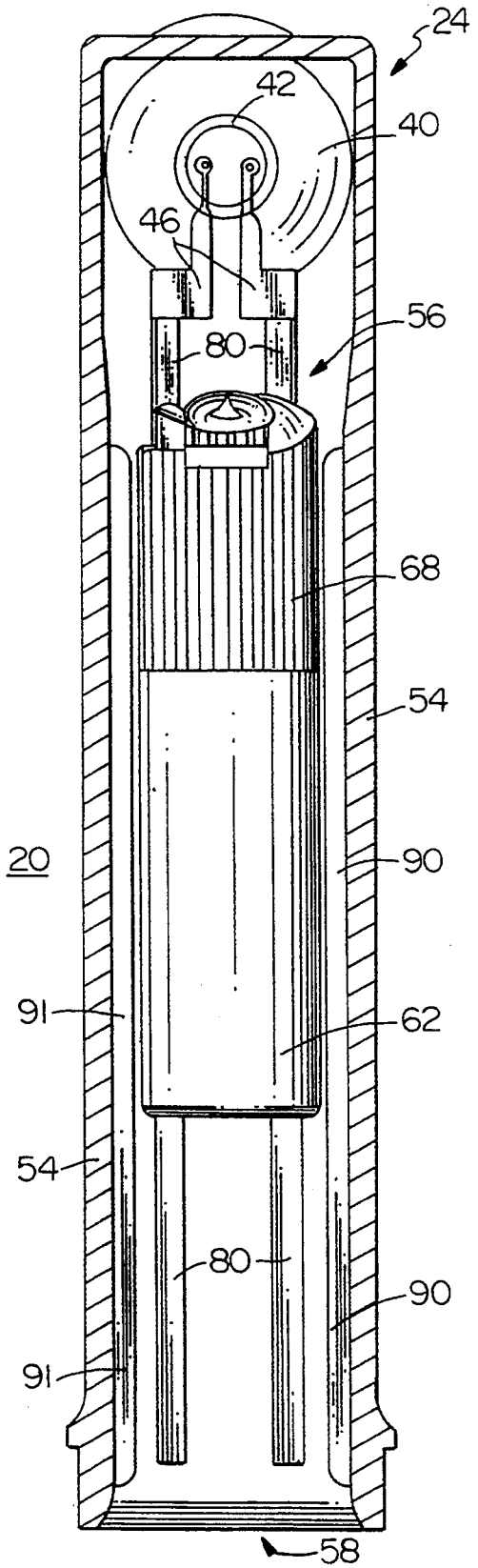
FIG. 4 is a longitudinal cross sectional view of the device in FIG. 1 taken along section line 4—4 thereof.
Figure 9:
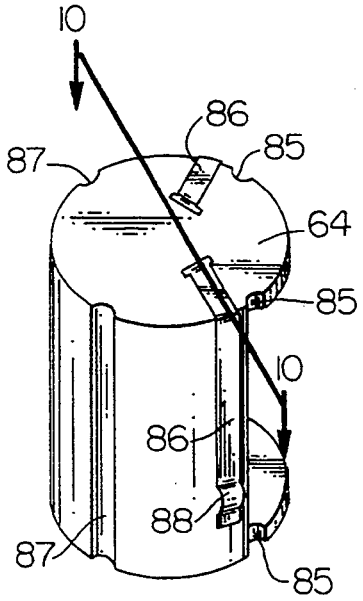
FIG. 9 is a perspective view of the battery pack employed in the device of the present invention.
Figure 5:
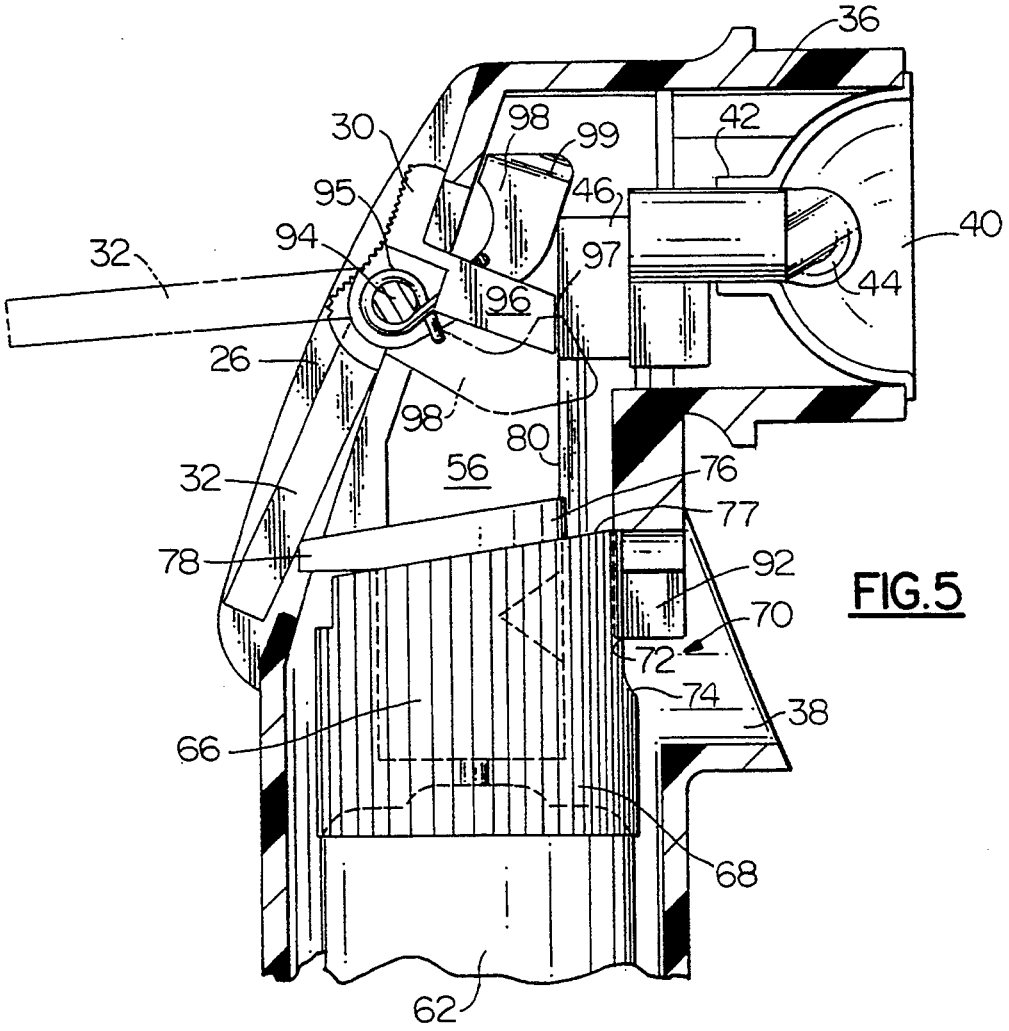
FIG. 5 is an enlarged detail view of the head portion of the device shown in FIG. 4.
Figure 6:
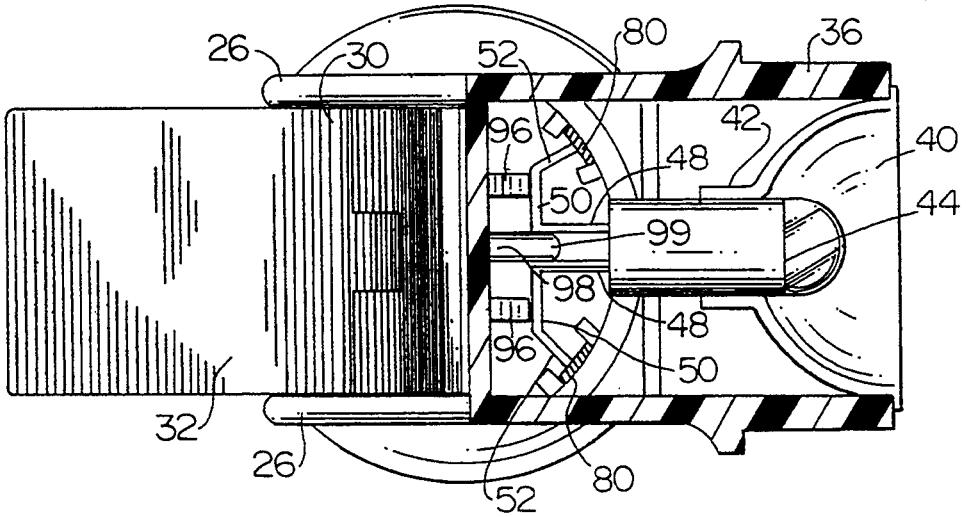
FIG. 6 is a top view in partial section of the present device as shown in FIG. 3.

With reference now to FIGS. 4, 5, and 6, it is shown that the protective dispenser 20 includes a reflector 40 having a base 42 and a lamp 44 contained therein. The lamp 44 is connected to a pair of flexible lamp terminals that are generally J-shaped, as best shown in FIG. 6. Each of the lamp terminals 46 includes a leg portion 48, a base 50, which is generally perpendicular to the leg 48, and a fluke-like tip 52, extending away from the base 50. The J-shaped lamp terminals 46 are positioned side-by-side to form a wing or anchor configuration as shown in FIG. 6. FIG. 4 in particular shows that the protective dispenser 20 includes a generally cylindrical interior side wall 54 which creates an internal cavity 56 extending from an end opening 58 into the head portion 24. The passage 33 opens into the cavity 56 as shown in FIG. 3. The end opening 58 is closeable by an end cover or cap 60, as shown in FIG. 1. With reference again to FIG. 4, it is shown that the dispenser 20 is enabled to receive within the internal cavity 56 a typical self-defense spray canister 62 and a battery pack 64, as shown in FIG. 9. Upon final assembly, the battery pack 64 is inserted into the internal cavity 56 through the end opening 58 to rest against the lower end of the spray canister 62. Both the spray canister 62 and the battery pack 64 are secured within the cavity 56 by the end cover 60.

Figure 7:
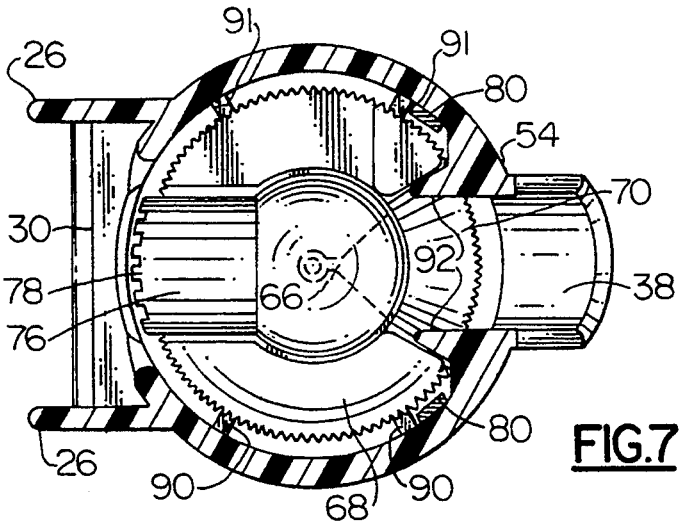
FIG. 7 is a cross sectional top view take along section line 7—7 of FIG. 1 showing a self-defense spray canister fully inserted into the device according to the present invention.
Figure 8:
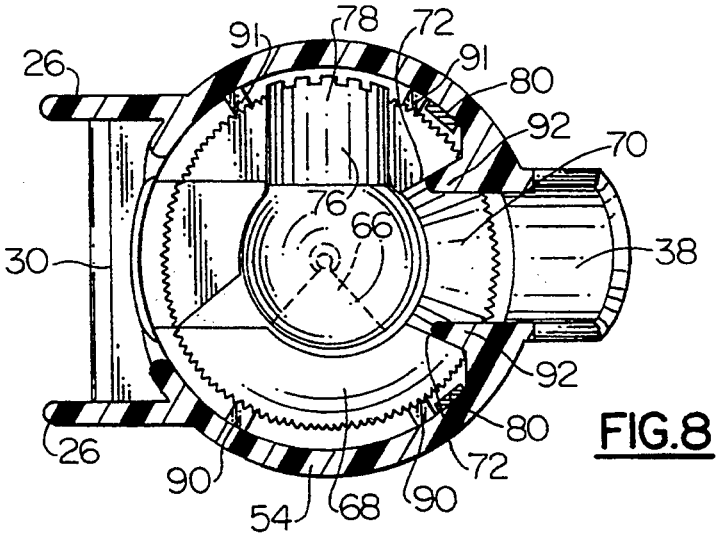
FIG. 8 is a view similar to FIG. 7 showing a self-defense spray canister partially inserted into the present device.

The spray canister 62 includes a nozzle shown in phantom in FIGS. 5, 7, and 8, a cap 68, and a nozzle aperture 70. The nozzle aperture 70 of the cap 68 of the self-defense spray canister 62 includes a pair of opposed side edges 72, and a bottom or lower portion 74 as best shown in FIG. 5. A turnable lever 76 is provided on the cap 68 of the canister 62. The cap 68 has a top 77 while the turnable lever 76 has a tip portion 78 which protrudes off the top 77 slightly beyond the cap 68.

Figure 10:
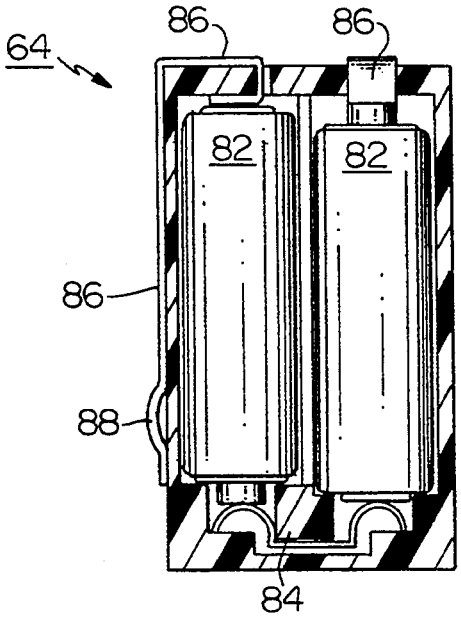
FIG. 10 is an enlarged detailed cross sectional view of the battery pack employed in the device of the present invention taken along section line 10—10 of FIG. 9.

As shown in FIGS. 4, 5, and 6, the protective dispenser 20 includes a pair of battery connectors 80 which extend from proximate the open end 58 up along the side wall 54 toward the head portion 24. The battery connectors 80 terminate proximate to the fluke-shaped tip portion 52 of a corresponding lamp terminal 46 as best shown in FIG. 6. Referring now to the battery pack 64 as shown in FIGS. 9 and 10, it is shown that the battery pack is enabled to receive a pair of dry cells 82 which are connected in series by a bar connector 84. The battery pack 64 is provided with a pair of battery terminals 86 which extend along the exterior side of the pack 64. Each of the battery terminals 86 is provided with a protruding lobe 88. To enable the battery pack 64 to be securely inserted into the handle segment 22 of the protective dispenser 20, the pack 64 is provided with notches 85 and slots 87 whose function will be described hereinafter.

The internal cavity 56 of the handle segment 22 is provided with two pair of parallel longitudinal side ribs 90 and 91 which are formed on the interior side wall 54 and are all parallel to the axis of elongation. As shown in FIGS. 7 and 8, the head portion 24 is provided with a pair of centering ribs directed inwardly along the spray aperture 38. As shown in FIG. 4, the two pair of longitudinal ribs 90 and 91 begin at a point proximate to the end opening 58 and terminate proximate the spray aperture 38.

The turnable lever 76 of the spray canister 62 has two positions. One is a locked position shown in FIG. 8 and the other is an operable position shown in FIG. 7. The locked position of the lever 76 is substantially ninety degrees counter-clockwise from the nozzle aperture 70, while the operable position of the lever 76 is approximately 180 degrees away from the nozzle aperture.

In accordance with one aspect of the present invention, the spray canister 62 may be completely inserted into the protective dispenser 20 only when the turnable lever 76 is in the locked condition. In this manner, the top portion 77 of the cap 68 of the spray canister 62 is insertable into the end opening 58 with the tip 78 of the lever 76 situated between the parallel longitudinal side ribs 91 as shown in FIG. 8. In this condition, the spray canister 62 may be easily inserted upwardly through the internal cavity 56 toward the head portion 24. As the canister 62 travels upwardly, the centering ribs 92 will engage the opposed side edges 72 of the nozzle aperture 70 of the cap 68. As the canister is fully inserted into the cavity 56, the centering ribs 92 will hit against the bottom portion 74 of the nozzle aperture 70, thus preventing the canister 62 from further forward movement within the cavity 56. As the centering ribs 92 engage the nozzle aperture 70, the lever 76 of the canister 62 will pass and clear the upper ends of the longitudinal side ribs 91. In this condition, as shown in FIG. 8, the lever 76 may be turned from the locked position to the operable position.

In the preferred embodiment of the present invention, the pair of longitudinal ribs 90 are included for structural support, it being understood that the typical canister 62 will be insertable in the locked condition for proper alignment within the spray aperture 38 of the head portion 24 only when the tip 78 of the lever 76 is situated between the longitudinal side ribs 91. Attempting to insert the canister 62 into the handle 22 in any other manner, i.e., with the lever tip 78 in the longitudinal side ribs 90, or while the lever 76 is in the operable condition will result in preventing the canister from complete and proper loading into the dispenser 20. This results because the top 77 of the canister cap 68 will hit against the bottom of the centering ribs 92, thus preventing proper alignment of the spray and nozzle apertures.

Once the spray canister 62 is fully inserted into the protective dispenser 20, as shown in FIGS. 4 and 8, the battery pack 64 may then be inserted into the lower portion of the handle segment 22. Proper alignment for correct polarity is achieved by aligning the notches 85 and the slots 87 of the battery pack 64 with the lower portion of the pairs of ribs 90 and 91. As can be seen in FIGS. 4 and 9, the battery connectors 80 are each offset by between approximately 35 and 45 degrees from the spray aperture 38. The battery terminals 86 on the battery pack 64 are similarly offset so that each protruding lobe 88 will come in contact with a respective battery connector 80 to complete the electrical connection between the battery pack 64 and the connectors 80. Given this offset mating configuration between the connectors 80 and terminals 86, the correct alignment between the pack 64 and handle segment 22 will be apparent to the user. In addition, the battery pack 64 is tapered so that it is slightly narrower on the top, as shown in FIG. 9, than at the bottom. A user will thereby be prevented from inserting the wrong end of the pack 64 into the handle segment 22.

Referring again to FIG. 5, it is shown that the upper and lower portions 30 and 32, respectively, of the articulating switch 28 are linked together by a hinge 94 which includes a spring 95. The spring 95 is coiled so as to bias the lower portion 32 closed against the passage 33. The upper portion 30 of the switch 28 is slidably retained between the raised ridges 26. In this manner, when the protective dispenser 20 is properly grasped in a user's hand, the entire switch 28 may be moved up and down in the condition shown in FIG. 2. Alternatively, the lower portion 32 may be easily flipped up into the condition shown in FIG. 3 and in phantom in FIG. 5.

As shown in FIGS. 5 and 6, a pair of contact blocks 96 is connected to the interior side of the upper portion 30 of the switch 28. Each contact block has a distal end 97 as best shown in FIG. 5. The lower portion 32 of the switch 28 includes a pivot arm or cam 98 whose proximal end is formed on the upper interior side of the lower portion 32. The distal end of the pivot arm 98 includes a wedge shaped end portion 99.

When the canister 62 is properly positioned within the dispenser 20 with the battery pack 64 positioned thereunder and the end cover 60 secured over the end opening 58, the dispenser 20 is in condition for use. At this point, the lower portion 32 of the switch 28 may be opened to the condition in FIG. 3 and the lever 76 rotated from the locked position shown in FIG. 8 to the operable position shown in FIG. 7. The lower portion 32 is then closed against the passage 33 to place the spray canister 62 in a stored, ready condition within the protective dispenser 20.

The lamp 44 may be activated by simply moving the articulating switch 28 upwardly when in the condition shown in FIG. 2. In this condition, i.e., with the lower portion 32 biased closed against the passage 33, the pair of contact blocks 96 will move upwardly until each distal end 97 thereof comes in contact with a respective base 50 of the lamp terminals 46. At this point, each contact block will push against a corresponding base of the lamp terminals so that each fluke-like tip 52 will move toward its respective battery connector 80. This action will result in making contact between the lamp terminals 46 and the battery terminals 86 thereby closing the circuit between the lamp 44 and the batteries 82.

Alternatively, the lamp 44 may be activated by using the thumb to flip upwardly the lower portion 32 into the condition shown in FIGS. 3, 6, and in phantom in FIG. 5. As the lower portion 32 is moved upwardly, the pivot arm 98 will move downwardly with the wedge shaped distal end 99 rotating between the two legs 48 of the lamp terminals 46. As the wedge rotates between the leg portions, the tips 52 will flex outwardly until they contact a respective battery connector 80, as shown in FIG. 6. In the preferred embodiment of the present invention, the tips 52 will contact a respective battery connector 80 after approximately twenty degrees of rotation of the pivot arm 98. As the pivot arm is fully rotated between the legs, the lower portion 32 will be biased in a fully extended position completely exposing the passage 33. In this condition, the thumb of the user may be easily inserted into the internal cavity 56 through the passage 33 to engage the lever 76 as preset to the operable position shown in FIG. 7. At this point, the self-defense spray may be directed and released from the nozzle 66 through the apertures 38 and 70 toward an intended target.

As is evident from the above description, the present device utilizes a light beam emanating from the source of illumination as a means for directing and aiming a stream or a shot of self-defense spray at a target. Because of the comfortable fit in the user's hand achieved by the finger grip 34 and the contour shape of the ridges 26, the forwardly directed beam of light may advantageously illuminate the user's path while walking. At any time during the user's walk, the beam of light can be quickly and accurately placed on the face of a potential attacker. This is possible even under the most stressful conditions or when the user is in a defensive posture. The light beam helps to identify the potential attacker and also impairs the attacker's ability to see the user. In the event the illuminated potential attacker is determined to be dangerous, the spray canister 62 may be triggered, thus propelling self-defense spray into the illuminated facial region of the identified attacker. The light beam also allows the user to clearly see the spray droplets of self-defense spray and thus determine if the spray is drifting back toward the user. If so, immediate action can be taken by the user to avoid contact with the blow-back.

While this invention has been described in detail with reference to a certain preferred embodiment, it should be appreciated that the present invention is not limited to that precise embodiment. Rather, in view of the present disclosure, many modifications and variations would present themselves to those of skill in the art without departing from the scope and spirit of this invention, as defined in the following claims.

What is claimed is:

1. A hand-held protective device adapted to receive a canister of self-defense spray, said device comprising:

an elongated handle segment having an axis of elongation, being easily gripped by one hand, and capable of supporting a battery source of power;

a head portion situated at one end of said elongated handle segment, said head portion having a front, a top a back and side walls formed between said top and back and including a source of illumination and a spray aperture formed proximate said source of illumination;

circuit means for electrically connecting said battery source to said source of illumination; and switch means disposed proximate said head portion and cooperatively engaged with said circuit means for opening and closing said circuit means while simultaneously preventing access to a canister of self-defense spray contained within the device, and closing said circuit means while allowing access to said canister;

wherein said canister includes a nozzle covered by a cap having a nozzle aperture for allowing spray to exit the nozzle through the cap, said nozzle aperture having opposed side edges and a lower portion, and said elongated handle segment includes a closeable end opening at an end thereof opposite to said one end upon which said head portion is situated, said closeable end opening being formed to allow the spray canister to pass therethrough.

2. The hand-held protective device according to claim 2 wherein said elongated handle segment includes a generally cylindrical interior side wall surrounding an internal cavity extending from the end opening of the handle segment to said head portion, said internal cavity being capable of receiving said spray canister in a loose sliding fit.

3. The hand-held protective device according to claim 2 wherein a portion of said elongated handle segment proximate said closeable end opening is formed to receive said battery source in a close sliding fit within said internal cavity and the end opening is secured closed by an end cover.

4. The hand-held protective device according to claim 2 wherein said source of illumination includes a lamp within a reflector having a base, said lamp and reflector positioned to illuminate a path of spray.

5. The hand-held protective device according to claim 4 wherein said lamp is a low wattage, high intensity arc lamp and said reflector is formed to direct light energy along a narrow beam toward a selected target.

6. The hand-held protective device according to claim 4 wherein said circuit means includes a pair of flexible lamp terminals connectable to the lamp and extending away from the base of the reflector into said internal cavity.

7. The hand-held protective device according to claim 6 wherein said head portion is formed substantially perpendicular to said elongated handle segment and each lamp terminal is generally J-shaped having a leg extending from the reflector base beyond the interior side wall and into said internal cavity, a base substantially perpendicular to the leg, and a fluke-like tip extending away from the base toward the side wall, the lamp terminals being positioned so that the legs thereof are parallel to each other and the bases are each directed outwardly thereby forming a wing configuration.

8. The hand-held protective device according to claim 7 wherein said circuit means further includes a pair of battery connectors being connectable at one end to said battery source and extending along the interior side wall, each of said battery connectors terminating on the side wall proximate one of the tips of the lamp terminals.

9. The hand-held protective device according to claim 8 wherein said head portion further includes a pair of narrow raised ridges being parallel to each other extending from the top of the head portion and sloping downwardly along the back thereof, said pair of ridges having a passage formed therebetween leading into said internal cavity and said switch means includes:

an articulating flat knob having an upper portion slidably retained between said pair of ridges and a lower portion being hinged to said upper portion and biased closed against said passage, said articulating flat knob thereby having an exterior side and an interior side completely covering said passage when said upper portion thereof is moved back and forth along the ridges;

a pair of contact blocks extending from the interior side of the upper portion of the knob into said internal cavity, each of said contact blocks terminating at a distal end being proximate to one of the bases of the flexible lamp terminals when the knob is in a downward position so that when the knob is moved upwardly, the distal end of each block will engage a respective base thereby flexing the lamp terminals toward the side wall until each of said fluke-like tips contacts its respective battery connector to connect the lamp to the battery source while the lower portion of the flat knob prevents access through said passage into said internal cavity.

10. The hand-held protective device according to claim 9 wherein the lower portion of said articulating flat knob includes a pivot arm having a proximal end formed on the interior side of said lower portion and a wedged-shaped distal end positioned proximate the legs of said pair of flexible lamp terminals when said lower portion is biased closed against said passage whereby when said lower portion of the knob is moved away from between said ridges to allow access through the passage to a canister of self-defense spray contained within the handle segment, the wedged-shaped distal end of said pivot arm will rotate in between the lamp terminal legs flexing the legs away from each other until each of said fluke-like tips contacts its respective battery connector to connect the lamp to the battery source.

11. The hand-held protective device according to claim 2 wherein said cap of said spray canister includes a turnable lever on a top thereof for locking and opening the canister nozzle, said lever having a tip end protruding away from the top.

12. The hand-held protective device according to claim 11 wherein said generally cylindrical interior side wall includes a pair of longitudinal ribs being parallel to said axis of elongation and extending from proximate the end opening of the handle segment to proximate said spray aperture of said head portion, said longitudinal ribs being spaced apart from each other a predetermined distance so that the tip end of said turnable lever of the canister cap is snugly retained between the longitudinal ribs in a slidable fit when said spray canister is positioned within the end opening and while the canister is being inserted into said internal cavity.

13. The hand-held protective device according to claim 12 further including a pair of inwardly directed centering ribs each being parallel to said axis of elongation and formed along opposing edges of said spray aperture so that when said spray canister is in the locked condition and positioned within the end opening of the handle segment with the tip end of the cap lever between said longitudinal ribs, the cap of the canister, upon being inserted into said internal cavity proximate the head portion, will engage said centering ribs along the opposing side edges of the nozzle aperture to align the nozzle aperture with said spray aperture.

14. The hand-held protective device according to claim 13 wherein the cap lever will disengage from between said pair of longitudinal ribs when the lower portion of the nozzle aperture is seated against the centering ribs, the cap lever thereby being free to turn.

* * * * *